US006569041B1

(12) United States Patent
Riivald

(10) Patent No.: US 6,569,041 B1
(45) Date of Patent: May 27, 2003

(54) ICE HOCKEY TRAINING APPARATUS

(76) Inventor: Erik Riivald, 52 Inlet Ter., Belmar, NJ (US) 07719

( * ) Notice: Subject to any disclaimer, the term of this patent is extended or adjusted under 35 U.S.C. 154(b) by 0 days.

(21) Appl. No.: 10/067,120

(22) Filed: Feb. 4, 2002

(51) Int. Cl.[7] ..... A63B 69/00
(52) U.S. Cl. ..... 473/446; 473/423
(58) Field of Search ..... 473/446, 476, 473/423, 422, 424, 437, 454, 478, 256

(56) References Cited

U.S. PATENT DOCUMENTS

| | | | | |
|---|---|---|---|---|
| 3,586,335 A | | 6/1971 | D'Antonio, Sr. | |
| 3,709,489 A | | 1/1973 | Holleran et al. | |
| 3,794,318 A | | 2/1974 | Holmes | |
| 3,863,917 A | * | 2/1975 | Beale | 473/425 |
| 3,955,815 A | | 5/1976 | Deschesnes | |
| 4,070,017 A | | 1/1978 | Lombardi | |
| 4,111,419 A | * | 9/1978 | Pellegrino | 473/425 |
| 4,607,842 A | | 8/1986 | Daoust | |
| 4,662,641 A | | 5/1987 | Peyret, Jr. | |
| 4,779,872 A | | 10/1988 | Bisbee | |
| 5,069,451 A | | 12/1991 | Martens et al. | |
| 5,139,263 A | | 8/1992 | Feo | |
| 5,161,799 A | | 11/1992 | Nandra | |
| 5,174,567 A | * | 12/1992 | Nordstrom | 473/446 |
| 5,226,821 A | | 7/1993 | Murphy et al. | |
| 5,249,797 A | | 10/1993 | Dowhy | |
| 5,465,958 A | | 11/1995 | Brun | |
| 5,509,652 A | | 4/1996 | Woronets | |
| 5,520,386 A | | 5/1996 | Sasko | |
| 5,584,481 A | * | 12/1996 | Caluori et al. | 473/446 |
| 5,688,197 A | | 11/1997 | Peeters et al. | |
| 5,707,304 A | * | 1/1998 | BelleIsle | 473/431 |
| 5,776,007 A | | 7/1998 | Kendall et al. | |
| 5,816,945 A | * | 10/1998 | Todd et al. | 473/425 |
| 6,042,511 A | | 3/2000 | Bulloch | |

* cited by examiner

*Primary Examiner*—Paul T. Sewell
*Assistant Examiner*—M. Chambers
(74) *Attorney, Agent, or Firm*—Sperry, Zoda & Kane

(57) ABSTRACT

A device for significantly enhancing the ability of ice hockey players of all experience levels for developing stick control and correct shooting movements while also increasing strength, balance and accuracy thereof which includes a framework defining a practice zone thereunder wherein a flexibly resilient member is secured to uniquely configured apertures defined in the blade of the training hockey stick to encourage correct stick movement and to discourage incorrect stick handling and shooting movements. The apertures are preferably located in the heel, the toe and/or the tip of the blade of the stick and are attached to the resilient member for building up strength and providing resistance thereto. The resilient member is knotted and positioned extending through one or more of the apertures in the stick blade and the apertures are shaped such as to retain the knot of the stick extending through the aperture responsive to correct stick movements and to release the knot responsive to incorrect stick movements. This teaching mechanism is achieved by forming apertures which includes a wider area on the tip side of the aperture and including narrow or more restricted areas on the heel part of the apertures.

21 Claims, 3 Drawing Sheets

ICE HOCKEY TRAINING APPARATUS

BACKGROUND OF THE INVENTION

1. Field Of The Invention

The present invention deals with the field of devices for sports training. In particular this device is usable for training of those individuals playing ice hockey wherein skating while simultaneously stick handling and shooting of a puck is an important skill to be learned.

2. Description Of The Prior Art

Numerous training devices for ice hockey and similar sports have been patented such as shown in U.S. Pat. No. 3,586,335 patented Jun. 22, 1971 to J. D'Antonio, Sr. on a "Golf Practice Device"; and U.S. Pat. No. 3,709,489 patented Jan. 9, 1973 to T. Holleran et al on a "Hockey Skill-Testing, Practice And Game Apparatus"; and U.S. Pat. No. 3,794,318 patented Feb. 26, 1974 to L. Holmes on a "Hockey Puck Practice Shooting Apparatus"; and U.S. Pat. No. 3,955,815 patented May 11, 1976 to G. Deschesnes on a "Hockey Training Device"; and U.S. Pat. No. 4,070,017 patented Jan. 24, 1978 to R. Lombardi on a "Hockey Practice Shooter"; and U.S. Pat. No. 4,607,842 patented Aug. 26, 1986 to R. Daoust on an "Exercising Apparatus For Use By Hockey Players To Practice Their Slap And Wrist-Shots"; and U.S. Pat. No. 4,662,641 patented May 5, 1987 to L. Peyret, Jr. on a "Golf Club Swing Training Device And Method"; and U.S. Pat. No. 4,779,872 patented Oct. 25, 1988 to D. Bisbee on a "Golf Swing Alignment Device"; and U.S. Pat. No. 5,069,451 patented Dec. 3, 1991 to K. Martens et al on a "Hockey Practice Device"; and U.S. Pat. No. 5,139,263 patented Aug. 18, 1992 to A. Feo and assigned to May Lee Feo on a "Golf Swing Alignment Device"; and U.S. Pat. No. 5,161,799 patented Nov. 10, 1992 to M. Nandra on a "Hockey Practice Apparatus Kit"; and U.S. Pat. No. 5,226,821 patented Jul. 13, 1993 to J. Murphy et al and assigned to Stickmaster, Inc. on a "Hockey Training Device"; and U.S. Pat. No. 5,249,797 patented Oct. 5, 1993 to W. Dowhy on a "Hockey Training Apparatus"; and U.S. Pat. No. 5,465,958 patented Nov. 14, 1995 to P. Brun on an "Off-Ice Hockey Shooting Practice Device"; and U.S. Pat. No. 5,509,652 patented Apr. 23, 1996 to E. Woronets on a "Hockey Practice Alley"; and U.S. Pat. No. 5,520,386 patented May 28, 1996 to J. Sasko on a "Hockey Stick Training Weight"; and U.S. Pat. No. 5,584,481 patented Dec. 17, 1996 to M. Caluori et al and assigned to Michael J. Caluori on "Training Accessories For Goal-Making Games"; and U.S. Pat. No. 5,688,197 patented Nov. 18, 1997 to P. Peeters et al on a "Method And Apparatus For Training Goalkeepers"; and U.S. Pat. No. 5,776,007 patented Jul. 7, 1998 to G. Kendall et al and assigned to George Kendall on a "Putting Practice Device"; and U.S. Pat. No. 5,816,945 patented Oct. 6, 1998 to P. Todd et al on a "Hockey Training Device"; and U.S. Pat. No. 6,042,511 patented Mar. 28, 2000 to R. Bullock on a "Hockey Training Apparatus".

SUMMARY OF THE INVENTION

The present invention provides a uniquely configured ice hockey training apparatus which is usable particularly for increasing strength, balance and accuracy in shooting and stick handling of the user.

The apparatus includes a main framework which has an upper bar member which is longitudinally extensible to facilitate use of the apparatus by users of different sizes which would require different lengths of movement of the stick head during shooting or stick handling exercises. The main framework also includes a first support member which is detachably securable with respect to the upper bar member in order to support it above the ground surface therebelow. In a preferred configuration this first support member will include a first leg extending downwardly from the upper bar member to facilitate support thereof in spaced relation from the environmental surface in order to facilitate defining of a practicing zone therebeneath. A second leg will also be preferably included extending downwardly from the upper bar to facilitate support thereof in spaced relation to the environmental structure in order to facilitate defining of the practicing zone therebeneath. This second leg will extend outwardly away from the first leg in order to define a guide orifice therebetween which is adapted to receive the longitudinally extending member therethrough. In this manner the longitudinal member will be guided from a fixed securement exterior to the main framework to a position within the practicing zone defined therein.

A second support member is also preferably detachably securable with respect to the upper bar member at a position spatially disposed from the first support member for further supporting thereof above the ground surface. This first support member and the second support member together define a practicing zone therebeneath at a position below the upper bar in order to facilitate use of the ice hockey training apparatus of the present invention.

A longitudinal device is preferably included secured to an environmental member or other external member such that it extends into the practicing zone between the first support and the second support below the upper bar member. This longitudinal bar is flexibly resilient longitudinally and preferably includes a knot means tied therein to facilitate restricted attachment and detachment thereof to the apertures defined in the blade means.

The apparatus of the present invention further includes a training stick which includes a handle capable of being grasped by a user during training. Such handles often include tape wound therearound to facilitate gripping. The blades of hockey sticks are often removable from the handles of currently used sticks and the unique head of the present invention is usable with a conventional or standard stick or can be used with a training stick if desired. The training or standard stick further includes a blade fixedly secured to the handle which is adapted to be moved within the practicing zone beneath the upper bar member and between the first support member and the second support member in order to enhanced development of strength, balance and accuracy in stick handling by the user. The blade defines at least one aperture therein. The blade is adapted to receive the longitudinal linear device extending through the aperture defined therein to facilitate detachable securement therewith. The longitudinal means provides flexible resilience to movement of the blade of the training or standard stick within the practicing zone in such a manner as to increase the strength, balance and accuracy in shooting and stick handling of a user.

The blade preferably includes a heel section adjacent the handle. This heel section defines the aperture in such a manner as to include a heel aperture which has a narrowed heel opening area in the region thereof closest to the handle in order to facilitate retaining of the longitudinal device within the heel aperture during proper practice shooting. Such proper practice shooting occurs when the tip portion of the blade is turned over downwardly during the follow through after a practice shot. The heel aperture further includes a widened heel opening area in the region thereof most distant from the handle in order to facilitate release of the longitudinal device from the heel aperture during improper practicing shooting wherein the tip section of the blade is turned facing upwardly during the follow through after a practice shot. The heel aperture defined in the heel section of the blade is preferably shaped similar to teardrop with the widest area closest to the tip area and the narrowest area thereof closest to the handle to facilitate release of the longitudinal device therefrom responsive to an improper shot follow through and to facilitate retaining of the longitudinal device therewithin responsive to proper shot follow through.

The tip section is further included spatially disposed distant from the handle and the heel area. The tip defines the aperture means such as to include a tip aperture. The tip aperture includes a narrowed tip opening area in the region thereof closest to the handle to facilitate retaining of the longitudinal means within the tip aperture during proper practice shooting. Such proper practice shooting is where the tip section of the blade is turned over downwardly during follow through after a practice shot. The tip aperture further includes a widened tip opening area in the region thereof most distant from the handle to facilitate release of the longitudinal device from within the tip aperture during improper practice shooting. Such improper practice shooting occurs when the tip section of the blade is turned facing upwardly during the follow through after a practice shot.

In the preferred configuration the tip aperture actually comprised a tip open notch means wherein the notch is defined in the tip area of the blade. This tip aperture preferably is also teardrop shaped with the widest area thereof closest to the tip area and the narrowest area thereof closest to the handle to facilitate release of the longitudinal device therefrom responsive to improper shot follow through and to facilitate retaining of the longitudinal device in the aperture responsive to proper shot follow through.

A central section is also defined intermediate between the heel area and the tip area. This central section defines the aperture to include a central aperture.

The central aperture includes a narrowed central opening area in the region thereof closest to the handle to facilitate retaining of the longitudinal device within the central aperture during proper practice shooting. Such proper practice shooting occurs when the tip section of the blade is turned over downwardly during follow through after a practice shot. The central aperture further includes a widened central opening area in the region thereof most distant from the handle in order to facilitate release of the longitudinal device from within the central aperture during improper practice shooting. The central aperture is defined in the central section of the blade means preferably having a teardrop shape with the widest area thereof closest to the tip area and the narrowest area thereof closest to the handle in order to facilitate release of the longitudinal means responsive to improper shot follow through and to facilitate retaining of the longitudinal device therewithin responsive to proper shot follow through.

A target may be included within the practice area of this device. This target device may be secured to the second support member immediately adjacent the practicing zone to provide a target for shooting and stick handling practice therewithin. The target preferably is made of a hard rubber and is shaped to simulate a hockey puck to enhance use thereof as a target during shooting and stick handling practice within the practice zone.

A weighted means may be positioned adjacent the first support member outside of the practice zone for attachment of the longitudinal member thereto for fixed securement thereof. This weighted device preferably defines a closable chamber opening means providing access to a ballast chamber defined therewithin. This ballast chamber is defined to receive ballast such as liquid or sand removably placed therein for providing a significantly heavy weighted device while at the same time allowing emptying thereof to enhance portability and movement thereof. The weighted means is important to provide a firm secure location for attaching of the longitudinal member thereto in order to make use of the flexible resilience thereof for strength training during movement of the hockey stick within the practicing zone.

In the preferred configuration the weighted means will include two pairs of connecting locations. Each pair of locations are preferably located diametrically opposite from one another to balance the force exerted on the weighted means during use thereof by several athletes such as occurs during team practice sessions. Each of these locations can includes a hook or loop to facilitate tethering of the four individual flexible resilient members thereto.

To reduce fatigue and to enhance the hockey-like experience two rotatable platforms may be included in the present invention such that the user can place his left foot on one of the platforms and his right foot on the other platform. These platforms will be rotatable with respect to the surrounding surface to simulate sliding movement on the ice during shooting as well as to simulate the slightly elevated position that the ice hockey player is in when taking a shot due to the vertical height of the blade extending downwardly from the hockey skates normally used in such games.

For this purpose a first rotatable platform will be adapted to be placed adjacent the main framework and will be adapted to be stood upon by the user and be rotatable during use of the training apparatus for facilitating shooting and stick handling to simulate ice conditions and for reducing fatigue. The first rotatable platform includes a first lower plate as well as a first upper plate with a first bearing means located therebetween.

Similarly a second rotatable platform means may be included adapted to be placed adjacent the main framework. This second rotatable platform means will be adapted to be stood upon by the other foot of the user and is rotatable during use of the training apparatus for shooting and stick handling to facilitate simulation of on-ice conditions and for reducing fatigue during practicing. The second rotatable platform will include a second lower plate and a second upper plate rotatably movable with respect to one another with a second bearing means therebetween to facilitate this relative movement. Each of the rotatable platforms may include rubber padding on the upper and/or lower surface to facilitate firm engagement thereof with respect to the feet of the user as well as with respect to the ground therebeneath.

It is an object of the present invention to provide an ice hockey training apparatus usable for increasing strength, balance and accuracy in shooting and stick handling of a user wherein closing of the toe of the blade of a hockey stick during follow through after a shot is encouraged.

It is an object of the present invention to provide an ice hockey training apparatus usable for increasing strength, balance and accuracy in shooting and stick handling of a user wherein maintaining of the blade face of a hockey stick facing upwardly and outwardly in an improper manner after shooting during the follow through is discouraged.

It is an object of the present invention to provide an ice hockey training apparatus usable for increasing strength, balance and accuracy in shooting and stick handling of a user which is extremely portable.

It is an object of the present invention to provide an ice hockey training apparatus usable for increasing strength, balance and accuracy in shooting and stick handling of a user which utilizes a minimum number of moving parts.

It is an object of the present invention to provide an ice hockey training apparatus usable for increasing strength, balance and accuracy in shooting and stick handling of a user which is easily maintained.

It is an object of the present invention to provide an ice hockey training apparatus usable for increasing strength, balance and accuracy in shooting and stick handling of a user which gives the user a feel closely simulating true ice hockey play conditions.

It is an object of the present invention to provide an ice hockey training apparatus usable for increasing strength, balance and accuracy in shooting and stick handling of a user wherein shooting and stick handling is made more simple and significantly strengthened.

It is an object of the present invention to provide an ice hockey training apparatus usable for increasing strength, balance and accuracy in shooting and stick handling of a user wherein a specific target is provided in the shape of a hockey puck for increasing strength, balance and accuracy in shooting and stick handling.

It is an object of the present invention to provide an ice hockey training apparatus usable for increasing strength, balance and accuracy in shooting and stick handling of a user wherein uniquely shaped apertures are defined in the blade of a practice hockey stick through which a longitudinally resiliently extensive member extends which provides resistance for strengthening hockey stick manipulation.

It is an object of the present invention to provide an ice hockey training apparatus usable for increasing strength, balance and accuracy in shooting and stick handling of a user wherein rotating disks are utilized to more accurately simulate ice hockey playing conditions.

It is an object of the present invention to provide an ice hockey training apparatus usable for increasing strength, balance and accuracy in shooting and stick handling of a user wherein the size of the stick manipulation area can be varied by increasing the length of the upper bar member as desired for different sizes of stick and for different sizes of individual users.

It is an object of the present invention to provide an ice hockey training apparatus usable for increasing strength, balance and accuracy in shooting and stick handling of a user wherein stick manipulation area can be varied by increasing the length of the upper bar member as desired for different positions assumed by the player to replicate forehanded and backhanded shots and passes.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 3 is an illustration of the embodiment shown in FIG. 2 with the longitudinal means extending therethrough depicting a toe-down correct shooting follow through;

DETAILED DESCRIPTION OF THE PREFERRED EMBODIMENT

Figure 1:
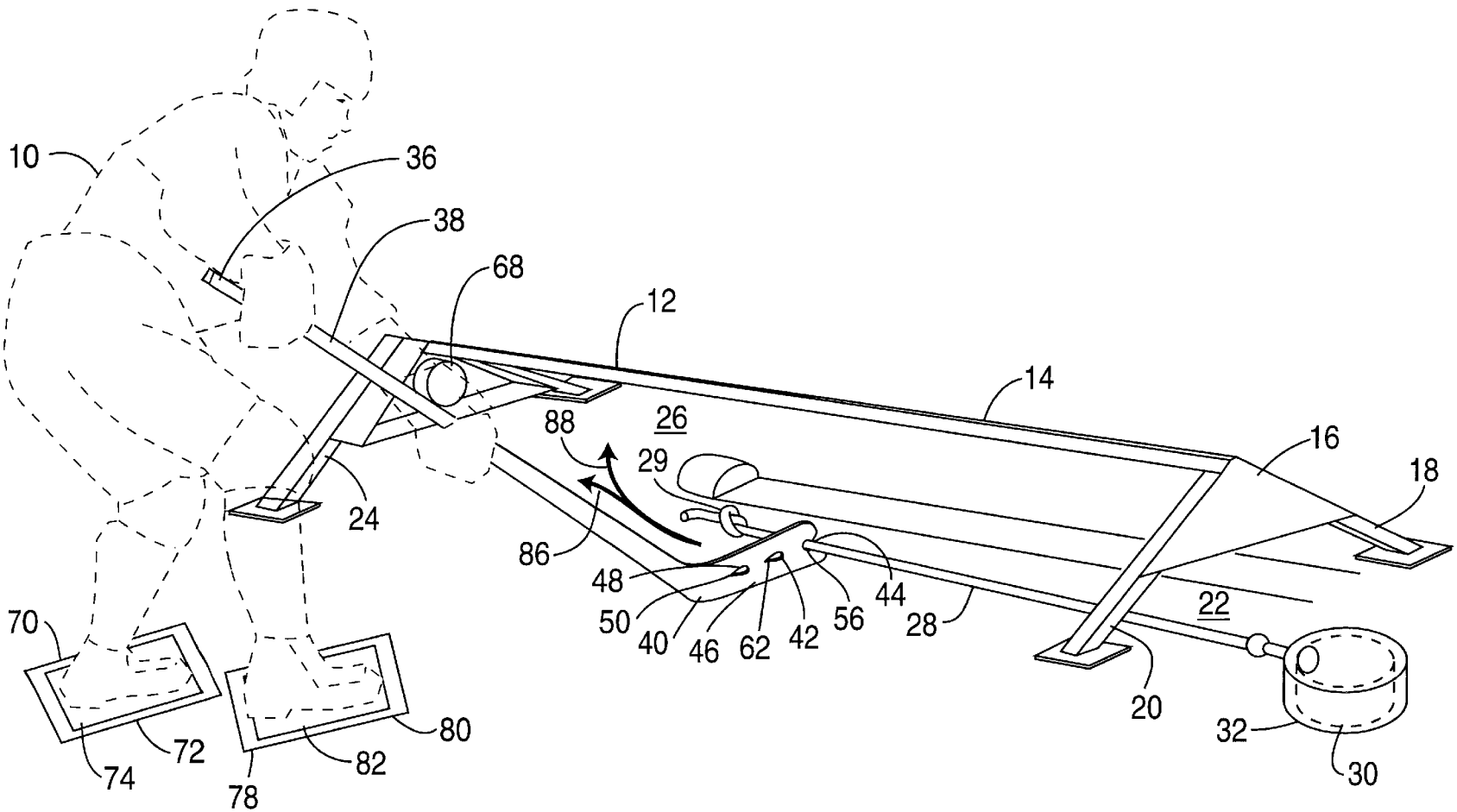
FIG. 1 is a perspective illustration of an embodiment of an ice hockey training apparatus of the present invention.

The present invention provides a uniquely configured ice hockey training apparatus for use by a user 10 which includes a main framework 12 comprising an upper bar member 14 as well as a first support member 16 and a second support member 24 preferably positioned at opposite ends thereof, as shown in this preferred embodiment.

The upper bar member 14 preferably is longitudinally extensible such as by telescoping in order to vary the distance between the first support member 16 and the second support member 24 and in this manner vary the size of the practicing zone 26 defined therebetween.

In the preferred configuration shown herein the first support member 16 will include a first leg 18 and a second leg 20 spaced from the first leg to define therebetween a guidance orifice 22.

Guidance orifice 22 is adapted to receive a longitudinal member such as a flexibly resilient member made of rubber or the like 28 extending therethrough. The longitudinal member 28 is defined to be secured to a fixed location which may be an environmental structure or could be a weighted means 30. Weighted means 30 is of sufficient weight such that the longitudinal member 28 when secured thereto will be flexibly resilient thereagainst. Weighted means 30 preferably defines a ballast chamber 32 therein adapted to receive ballast through a closable chamber opening 34 in fluid flow communication therewith. The ballast chosen may be water or sand which allows the weighted device 30 to be significantly heavy when utilized to provide a firm and fixed support for the longitudinal member 28 while at the same time allowing it to be portable merely by emptying the ballast from the ballast chamber 32 therein. In this manner portability is significantly enhanced. Preferably weighted device 30 can include two sets of loops or hooks or other attachment means thereon. Each pair of such connecting locations will be diametrically oppositely positioned on the weighted device 30 for balance the forces exerted thereon when multiple players are using multiple practice devices simultaneously. Normally only one weighted device 30 need be used with as many as four practice devices and the forces need to be apply thereto oppositely to maintain stability thereof.

A training stick 36 is preferably included with the present invention including a handle 38 adapted to be grasped by a user 10 and a blade 46 preferably at the lower end of the handle 38. Handle 38 commonly includes tape wound around the portion being grasped by the user 10 such as shown in FIG. 1. The blade 46 preferably includes a heel section 40 immediately adjacent the handle and a tip section 42 spatially disposed most distant from the handle and a central section 44 intermediate between the heel section 40 and the tip section 42. A hockey puck can be directed as desired by a user 10 by causing contact thereof with the tip section 42 or the heel section 40 or the central section 44 for various different effects during a hockey game.

Figure 4:
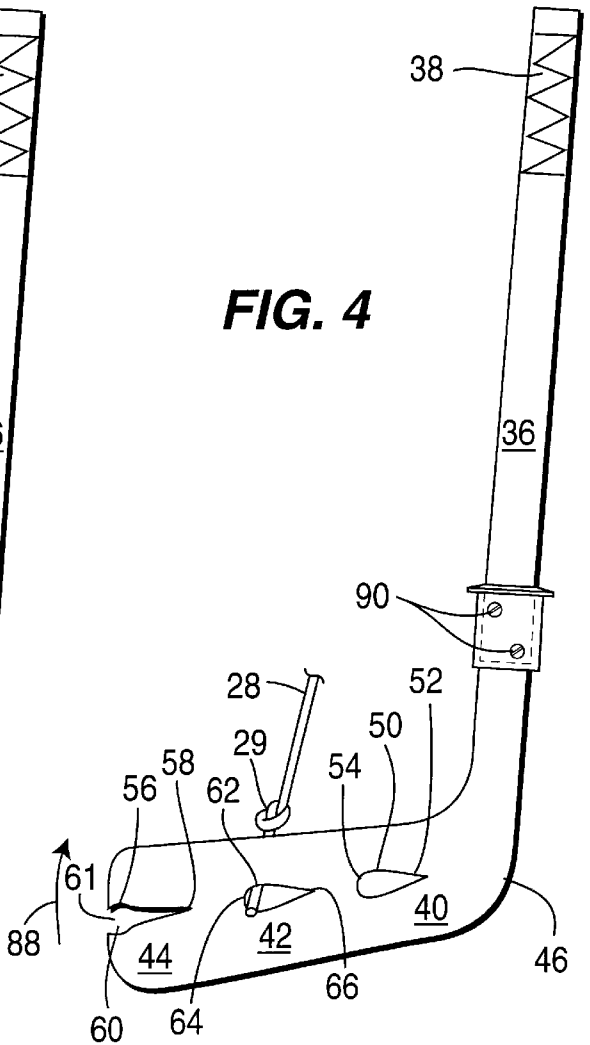
FIG. 4 is an illustration of an alternative embodiment with the longitudinal means extending therethrough depicting a tow-open incorrect shooting follow through and FIG. 4 also shows the optional configuration with the blade being detachable from the stick handle.
Figure 3:
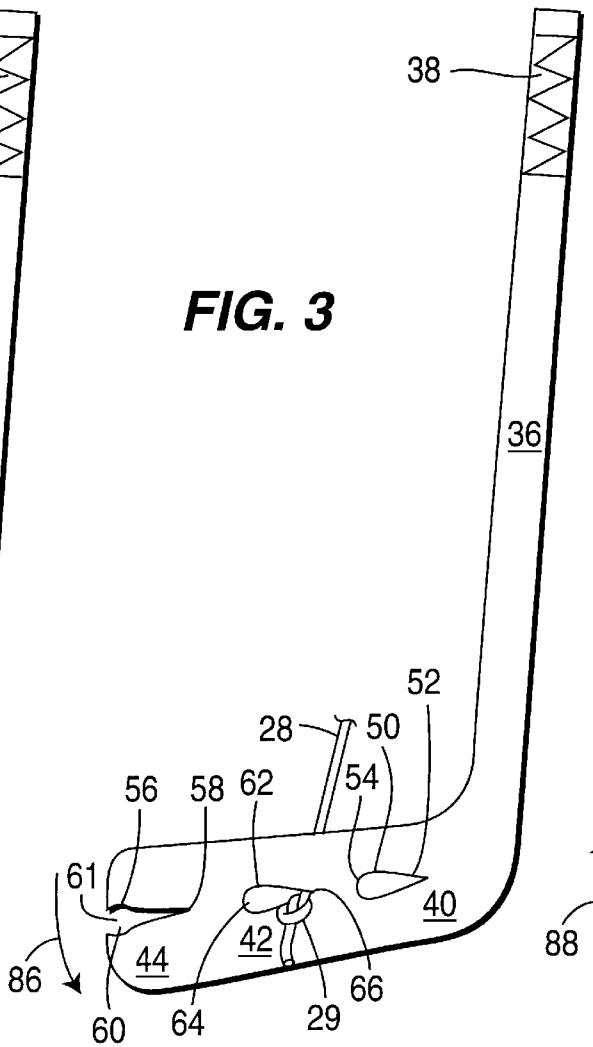
Figure 2:
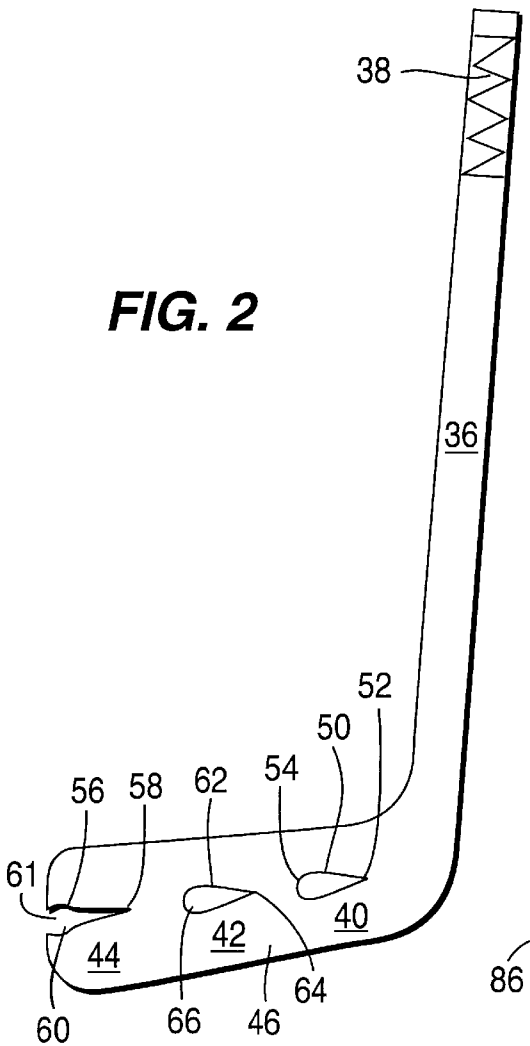
FIG. 2 is a front plan view of an embodiment of a training stick for use with the present invention.
Figure 5:
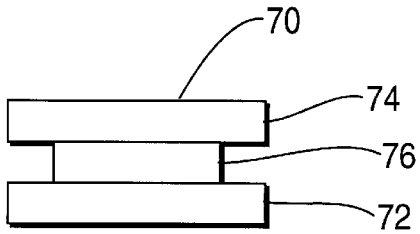
FIG. 5 is a front plan view of an embodiment of a first rotatable platform for use in the present invention.
Figure 6:
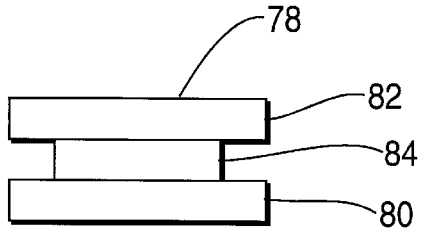
FIG. 6 is a front plan view of an embodiment of the second rotatable platform of the present invention.

The training aspect of the training stick 36 of the present invention is defined by having one or more individual apertures 48 defined in the blade 46 of the training stick 36. The individual apertures can comprise a heel aperture 50 defined in the heel area or a tip aperture 56 defined in the tip area or a central aperture 62 defined in the central or intermediate area. As shown in FIGS. 2, 3 and 4 all three such apertures can be included in a single blade to provide a more universal usage for the training stick 36.

In the preferred configuration of the present invention the longitudinal member 28 which is of a flexibly resilient material such as rubber will be secured with respect to the fully ballasted weighted means 30. The longitudinal member 28 will then extend through the guidance orifice 22 between the first and second leg members 18 and 20 into the practicing zone 26. At this point the longitudinal member 28 will then be placed through the heel aperture 48, the tip aperture 56 or the central aperture 62 and the user will tie a knot in the end preferably of the longitudinal member 28 as shown best in FIGS. 1 and 3. This knot will then tend to retain the longitudinal member 28 within the particular aperture 48 through which it extends. This knot will restrict but will not completely prevent removal of the longitudinal member 28 therefrom.

The configuration of the individual apertures is important to consider in accordance with the present invention since the present invention is designed to encourage proper stick handling and shooting practice movements, most particularly the use of the correct follow through movements. When shooting it is most preferable to point the tip section 42 of the blade 46 toward the target after shooting. Thus the blade 46 is closed or turned downwardly toward the user 10. It is improper to allow the tip section 42 to extend outwardly such that the blade faces upwardly when performing follow through after shooting since this is a much less accurate manner of shooting a hockey puck.

To enhance proper practice procedures the heel aperture 50 will preferably be formed of a non-uniform width wherein a narrowed heel opening area 52 will be positioned closest to the handle 38 and a widened heel opening area 54 will be positioned in the portion of the heel aperture 50 closest to the tip section 42. This will form a generally teardrop shaped aperture.

The effect of this teardrop shape is that as the user practices shooting, if the follow through after the shot is toe down such that the blade 46 turns toward the user 10 which is the correct manner of shooting, the knot 29 of the longitudinal member 28 will be retained since it is urged to move toward the narrowed heel opening area 52.

On the other hand, if the user 10 shoots in such a manner that the blade 46 faces upwardly and outwardly which is the improper follow through method, the longitudinal member 28 will move toward the widened heel opening area 54 to allow release thereof rearwardly causing disengagement between the longitudinal member 28 and the blade 46. This disengagement will signal to the user that they have performed the improper follow through after shooting.

A similar corrective operation will be achieved by the teardrop shape preferred in the tip aperture 56. The tip aperture means 56 preferably includes a narrowed tip area 58 in the portion thereof closest to the handle 38. The tip aperture 56 further includes a widened tip opening area 60 in the area thereof closest to the tip of the blade 46 or furthest from the handle 38. In the most preferred configuration the tip aperture 60 will be shaped as a tip open notch 61 opened to the tip and thereby not forming a completely closed aperture in the blade 46. With either shape the knot 29 of the longitudinal member 28 will move toward the narrowed tip opening area 58 whereas on the other hand, if an incorrect follow through is made with the blade 46 in the opened position, the knot 29 of longitudinal member 28 will move to the widened open area 60 and thereby be released from blade 46.

FIGS. 3 and 4 show the engagement of knot 29 of the longitudinal member 28 with respect to the central aperture 62 in a more detailed manner. This central aperture 62 preferably is formed such as to have a narrowed central opening area 64 furthest from the handle 38 and a widened central opening area 66 in the portion of the central aperture 62 closest to the handle 38. This will form a teardrop shaped central aperture 62. The portion thereof closest to the handle will be the narrowed area 64 which will have the greatest capability of grasping of the knot 29 of the longitudinal member 28. Thus when a proper shot follow through 86 is made with the blade tip turning over toward the user into a closed position, the knot 29 of the longitudinal member 28 will move toward the narrowed central opening area 64 facilitating grasping thereof. Thus, in this situation, the knot 29 will not be released.

On the other hand, if the improper shot follow through as shown by arrow 88 in FIG. 4 is performed, then the knot 29 of longitudinal member 28 will be caused to move toward the widened central opening area 66 of the central aperture 62 which will allow the knot 29 to move through this larger or widened central opening area 66 thereby disengaging the longitudinal member 28 from the central aperture 62. This release will comprise a manner of teaching to the user 10 that they have performed an improper shot follow through as shown by 88 and should concentrate on making the proper shot follow through as shown by arrow 86 in FIG. 3.

FIG. 4 also illustrates the capability of using the apparatus of the present invention with a hockey stick configuration where the blade 46 is designed to be selectively detachable with respect to the handle 38. Screws 90 show only one of many possible detachable securement means capable of securely holding the blade to the handle while still allowing detachment if desired. With this design a hockey player can use his own handle with the instructional blade 46 of the present invention.

The actual shape of the apertures 48 can be teardrop shaped or can be keyhole shaped or any shape wherein the portion on the blade 46 closer to the handle 38 is narrower and the portion of the aperture more distant from the handle 38 is larger to allow the knot to more easily pass therethrough.

With the apparatus of the present invention a target 68 may be included preferably which is formed of a hard rubber in a round shape similar to a hockey puck. This is shown in FIG. 1 and is the target against which the user when operating with proper shooting and passing manipulations will cause the tip section 42 of the blade 46 to bear against. Thus, contacting of the tip section 42 against the puck-shaped target 68 will be another indication to the user that they have performed the proper shot follow through 86 with the blade tip turning over toward the user and ending pointing in the direction that the puck is being passed or shot.

One of the important characteristics of the present invention is in the necessity of giving the user 10 the feeling that they are on ice. There are two main characteristics of being on the ice rather than in normal street shoes that are important to simulate when taking shots. The first is the decreased coefficient between the bottom of the user's feet and the surface. Commonly when taking the shot or passing a hockey puck using a stick 36 the user's feet will slide on the ice. This sliding can be simulated by positioning two rotatable platforms one under each shoe of the user. These platforms also raise the user off of the ground or surrounding earth and substrate to an extent to approximately simulate the added elevation caused by a blade being beneath the boot of a user during normal ice hockey conditions.

This simulation will be achieved by forming a first rotatable platform 70 having a first lower plate 72 placed on the ground and a first upper plate 74 adapted to receive the user's foot. A first bearing means 76 is positioned between the first lower plate 72 and the first upper plate 74 for allowing them to rotate relative to one another. In a similar manner a second rotatable platform 78 may be defined formed from a second lower plate 80 and a second upper plate 82 rotatably mounted with respect to one another and including a second bearing 84 therebetween to facilitate this relative rotational movement. When a user 10 places one foot on the first upper plate 74 and the other foot on the second upper plate 82 the increased elevation will simulate the increased elevation of being on skates with a skate blade under foot and the movability with respect to the surrounding environmental ground surface will simulate the lower coefficient of friction achieved between skates and the ice as opposed to normal footwear and the ground. This simulation will greatly enhance the overall feel of the shooting and stick handling of the ice hockey training apparatus of the present invention.

Figure 7:
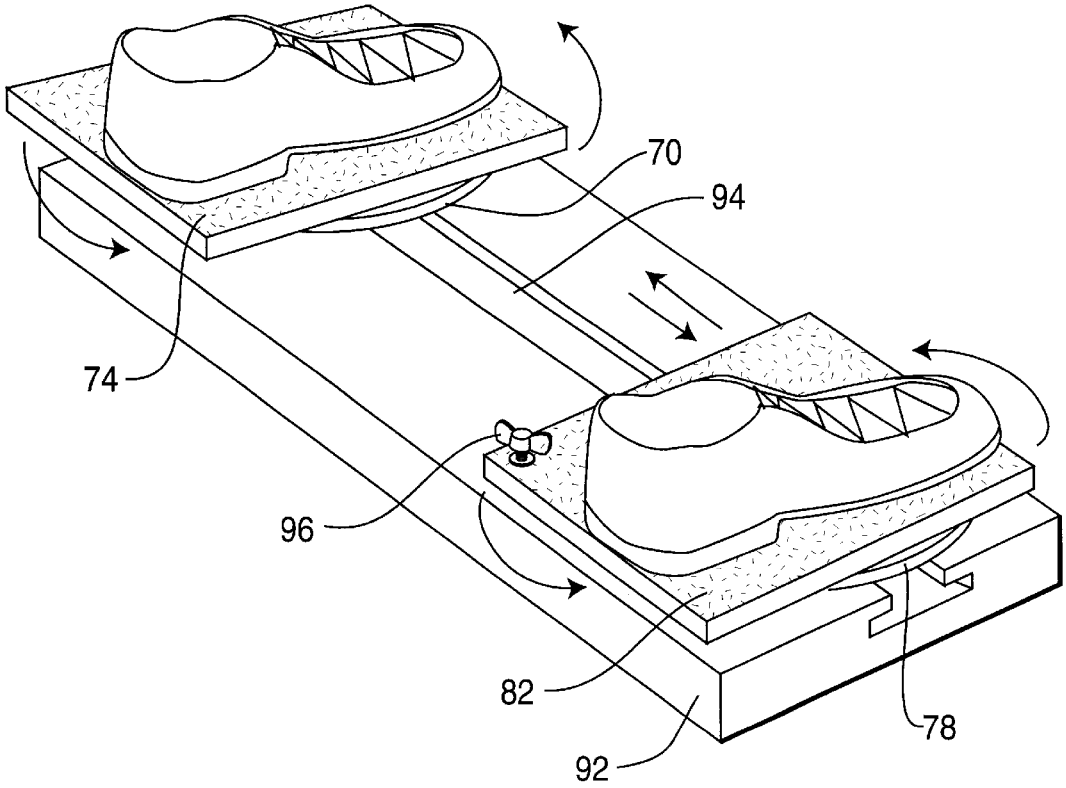
FIG. 7 is an alternative configuration for the rotatable platform of the present invention wherein two rotatable upper members are mounted in an adjustment slot defined in the upper surface of a single lower plate member.

An alternative configuration for the foot placement device is shown in FIG. 7. Here a single lower plate 92 is included which defines an adjustment slot 94 in the upper surface thereof. Both the first bearing means 76 and the second bearing means 84 are mounted in the slot 94 to allow adjustment in the lateral dimension between the two bearing members based upon the width of the stance of the particular individual currently utilizing the practice device. With this configuration both the first upper plate means 74 and the second upper plate means 82 will be separately movable as with the configuration having two separate lower plate means 72 and 80. A locking wing nut means 96 may extend through the second upper plate means 84 to facilitate securement thereof with respect to the lower plate 92 as desired for stability or for width stance distance adjustment.

There are several other possible configurations of which the present invention can be significantly enhanced, for example as shown in FIG. 1 the second support member 24 can also be formed with two leg members similar to the first support member 16. Also the individual legs can each include an enlarged foot area to facilitate contact with the horizontal surface. Also the weighted means 30 can be of significant weight such as to allow a multiple individual main framework to extend outwardly therefrom in one, two or as many as four or more directions to provide multiple training sites such as during a team practice.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A hockey training apparatus, usable for increasing strength, balance and accuracy in the shooting and stick handling of a user which is usable with a standard hockey stick, comprising:

A. a main framework means comprising:
  (1) an upper bar member;
  (2) a first support member detachably securable with respect to said upper bar member for supporting thereof above the ground surface therebelow; and
  (3) a second support member detachably securable with respect to said upper bar member at a position spatially disposed from said first support member for further supporting thereof above the ground surface therebelow, said first support member and said second support member together defining a practicing zone means therebetween below said upper bar member to facilitate use of the ice hockey training apparatus;

B. a longitudinal member extending into said practicing zone means between said first support member and said second support member below said upper bar member, said longitudinal member being flexibly resilient longitudinally;

C. a blade means securable to a standard hockey stick and adapted to be moved within said practicing zone means beneath said upper bar member and between said first support member and said second support member to enhance development of strength, balance and accuracy in stick handling by the user, said blade means defining at least one aperture means defined therein, said blade means adapted to receive said longitudinal member extending through said aperture means defined therein for detachable securement therewith, said longitudinal member providing flexible resistance to movement of said blade means of said training stick means within said practicing zone means to increase strength, balance and accuracy in shooting and stick handling of a user, said blade means including:
  a. a heel section adjacent said handle means;
  b. a tip section spatially disposed distant from said handle means and said heel area; and
  c. a central section located intermediate between said heel are and said tip area.

2. An ice hockey training apparatus, usable for increasing strength, balance and accuracy in the shooting and stick handling of a user, as defined in claim 1 further comprising a training stick means including a handle means capable of being grasped by a user during training therewith, said handle means being attachable directly to said blade means to facilitate training therewith.

3. An ice hockey training apparatus, usable for increasing strength, balance and accuracy in the shooting and stick handling of a user, as defined in claim 1 wherein said longitudinal member includes a knot means tied therewithin to restriction detachment of said longitudinal member from said blade means by removal of said longitudinal member from said aperture means.

4. An ice hockey training apparatus, usable for increasing strength, balance and accuracy in the shooting and stick handling of a user, as defined in claim 3 wherein said aperture means includes a central aperture means defined in said central section of said blade means and a tip aperture means defined in said tip section of said blade means and an heel aperture means defined in said heel section of said blade means.

5. An ice hockey training apparatus, usable for increasing strength, balance and accuracy in the shooting and stick handling of a user, as defined in claim 4 wherein said central aperture means includes a narrowed central opening area in the region thereof closest to said handle means to facilitate retaining of said longitudinal member within said central aperture means during proper practice shooting wherein the tip section of said blade means is turning over downwardly during follow through after a practice shot.

6. An ice hockey training apparatus, usable for increasing strength, balance and accuracy in the shooting and stick handling of a user, as defined in claim 5 wherein said central aperture means includes a widened central opening area in the region thereof most distant from said handle means to facilitate release of said longitudinal member from within said central aperture means during improper practicing shooting wherein the tip section of said blade means is turning facing upwardly during follow through after a practice shot.

7. An ice hockey training apparatus, usable for increasing strength, balance and accuracy in the shooting and stick handling of a user, as defined in claim 4 wherein said tip aperture means includes a narrowed tip opening area in the region thereof closest to said handle means to facilitate retaining of said longitudinal member within said tip aperture means during proper practice shooting wherein the tip section of said blade means is turning over downwardly during follow through after a practice shot.

8. An ice hockey training apparatus, usable for increasing strength, balance and accuracy in the shooting and stick handling of a user, as defined in claim 7 wherein said tip aperture means includes a widened tip opening area in the region thereof most distant from said handle means to facilitate release of said longitudinal member from within said tip aperture means during improper practicing shooting wherein the tip section of said blade means is turning facing upwardly during follow through after a practice shot.

9. An ice hockey training apparatus, usable for increasing strength, balance and accuracy in the shooting and stick handling of a user, as defined in claim 4 wherein said heel aperture means includes a narrowed heel opening area in the region thereof closest to said handle means to facilitate retaining of said longitudinal member within said heel aperture means during proper practice shooting wherein the tip section of said blade means is turning over downwardly during follow through after a practice shot.

10. An ice hockey training apparatus, usable for increasing strength, balance and accuracy in the shooting and stick handling of a user, as defined in claim 9 wherein said heel aperture means includes a widened heel opening area in the region thereof most distant from said handle means to facilitate release of said longitudinal member from within said heel aperture means during improper practicing shooting wherein the tip section of said blade means is turning facing upwardly during follow through after a practice shot.

11. An ice hockey training apparatus, usable for increasing strength, balance and accuracy in the shooting and stick handling of a user, as defined in claim 4 wherein said tip aperture means comprises a tip open notch means defined in the tip area of said blade means most distant from said handle means.

12. An ice hockey training apparatus, usable for increasing strength, balance and accuracy in the shooting and stick handling of a user, as defined in claim 4 wherein said central aperture means defined in said central section of said blade means and said tip aperture means defined in said tip section of said blade means and said heel aperture means defined in said heel section of said blade means are all teardrop-shaped with the widest area closest to said tip area and the narrowest area thereof closest to said handle means to facilitate release of said longitudinal member therefrom responsive to improper shot follow through and to facilitate retaining of said longitudinal member therewithin responsive to proper shot follow through.

13. An ice hockey training apparatus, usable for increasing strength, balance and accuracy in the shooting and stick handling of a user, as defined in claim 2 wherein said upper bar member is longitudinally extensible to increase the longitudinal dimensions of said practicing zone means.

14. An ice hockey training apparatus, usable for increasing strength, balance and accuracy in the shooting and stick handling of a user, as defined in claim 2 wherein said first support member includes:

A. a first leg means extending downwardly from said upper bar member to facilitate support thereof in spaced relation from the environmental surface to facilitate defining of said practicing zone therebeneath;

B. a second leg means extending downwardly from said upper bar member to facilitate support thereof in spaced relation from the environmental surface to facilitate defining of said practicing zone therebeneath, said second leg means extending outwardly away from said second leg means to define a guide orifice means therebetween adapted to receive said longitudinal member extending therethrough for guiding thereof to extend into said practicing zone means.

15. An ice hockey training apparatus, usable for increasing strength, balance and accuracy in the shooting and stick handling of a user, as defined in claim 2 further comprising a target means secured to said second support member immediately adjacent said practicing zone means to provide a target for shooting and stick handling practice therewithin.

16. An ice hockey training apparatus, usable for increasing strength, balance and accuracy in the shooting and stick handling of a user, as defined in claim 15 wherein said target means is made of hard rubber and is shaped to simulate a hockey puck to enhance use thereof as a target during shooting and stick handling practice within said practicing zone means.

17. An ice hockey training apparatus, usable for increasing strength, balance and accuracy in the shooting and stick handling of a user, as defined in claim 2 further comprising a weighted means positioned adjacent said first support member for attachment to said longitudinal member for fixed securement thereof outside of said practicing zone means.

18. An ice hockey training apparatus, usable for increasing strength, balance and accuracy in the shooting and stick handling of a user, as defined in claim 2 wherein said weighted means defining a closable chamber opening means and a ballast chamber means therewithin in fluid flow communication with respect to one another, said closable chamber opening means being operable to facilitate removable placement of ballast into said weighing chamber means to increase the weight of said weighing means, said ballast chamber also being capable of being emptied of ballast through said closable chamber opening means for enhancing portability thereof.

19. An ice hockey training apparatus, usable for increasing strength, balance and accuracy in the shooting and stick handling of a user, as defined in claim 2 further including:

A. a first rotatable platform means adapted to be placed adjacent said main framework means, said first rotatable platform means adapted to be stood upon by a user and being rotatable during use of the training apparatus for shooting and stick handling to facilitate simulation of on ice conditions and for reducing fatigue during practicing, said first rotatable platform means including:

(1) a first lower plate means engaging the ground adjacent said main framework means;

(2) a first upper plate means rotatably mounted with respect to said first lower plate means and adapted to be stood upon by a user during practicing;

(3) a first bearing means mounting between said first lower plate means and said first upper plate means to facilitate relative rotational movement therebetween; and B. a second rotatable platform means adapted to be placed adjacent said main framework means, said second rotatable platform means adapted to be stood upon by a user and being rotatable during use of the training apparatus for shooting and stick handling to facilitate simulation of on ice conditions and for reducing fatigue during practicing, said second rotatable platform means including:

(1) a second lower plate means engaging the ground adjacent said main framework means;

(2) a second upper plate means rotatably mounted with respect to said second lower plate means and adapted to be stood upon by a user during practicing;

(3) a second bearing means mounting between said second lower plate means and said second upper plate means to facilitate relative rotational movement therebetween.

20. An ice hockey training apparatus, usable for increasing strength, balance and accuracy in the shooting and stick handling of a user, comprising:

A. a main framework means comprising:

(1) an upper bar member;

(2) a first support member detachably securable with respect to said upper bar member for supporting thereof above the ground surface therebelow; and (3) a second support member detachably securable with respect to said upper bar member at a position spatially disposed from said first support member for further supporting thereof above the ground surface therebelow, said first support member and said second support member together defining a practicing zone means therebetween below said upper bar member to facilitate use of the ice hockey training apparatus;

B. a longitudinal member extending into said practicing zone means between said first support member and said second support member below said upper bar member, said longitudinal member being flexibly resilient longitudinally, said longitudinal member including a knot means tied therewithin to restriction detachment of said longitudinal member from said blade means by removal of said longitudinal member from said aperture means;

C. a training stick means comprising:

(1) a handle means capable for being grasped by a user during training; and (2) a blade means fixedly secured to said handle means and adapted to be moved within said practicing zone means beneath said upper bar member and between said first support member and said second support member to enhance development of strength, balance and accuracy in stick handling by the user, said blade means defining at least one aperture means defined therein, said blade means adapted to receive said longitudinal member extending through said aperture means defined therein for detachable securement therewith, said longitudinal member providing flexible resistance to movement of said blade means of said training stick means within said practicing zone means to increase strength, balance and accuracy in shooting and stick handling of a user, said blade means including:

a. a heel section adjacent said handle means, said heel section defining said aperture means including a heel aperture means, said heel aperture means including a narrowed heel opening area in the region thereof closest to said handle means to facilitate retaining of said longitudinal member within said heel aperture means during proper practice shooting wherein the tip section of said blade means is turning over downwardly during follow through after a practice shot, said heel aperture means further including a widened heel opening area in the region thereof most distant from said handle means to facilitate release of said longitudinal member from within said heel aperture means during improper practicing shooting wherein the tip section of said blade means is turning facing upwardly during follow through after a practice shot;

b. a tip section spatially disposed distant from said handle means and said heel area, said tip section defining said aperture means including a tip aperture means, said tip aperture means including a narrowed tip opening area in the region thereof closest to said handle means to facilitate retaining of said longitudinal member within said tip aperture means during proper practice shooting wherein the tip section of said blade means is turning over downwardly during follow through after a practice shot, said tip aperture means further including a widened tip opening area in the region thereof most distant from said handle means to facilitate release of said longitudinal member from within said tip aperture means during improper practicing shooting wherein the tip section of said blade means is turning facing upwardly during follow through after a practice shot, said tip aperture means comprising a tip open notch means defined in the tip area of said blade means most distant from said handle means; and c. a central section located intermediate between said heel area and said tip area, said central section defining said aperture means including a central aperture means, said central aperture means including a narrowed central opening area in the region thereof closest to said handle means to facilitate retaining of said longitudinal member within said central aperture means during proper practice shooting wherein the tip section of said blade means is turning over downwardly during follow through after a practice shot, said central aperture means further including a widened central opening area in the region thereof most distant from said handle means to facilitate release of said longitudinal member from within said central aperture means during improper practicing shooting wherein the tip section of said blade means is turning facing upwardly during follow through after a practice shot.

21. An ice hockey training apparatus, usable for increasing strength, balance and accuracy in the shooting and stick handling of a user, comprising:

A. a main framework means comprising:

(1) an upper bar member, said upper bar member being longitudinally extensible to facilitate use of the apparatus by users of different sizes;

(2) a first support member detachably securable with respect to said upper bar member for supporting thereof above the ground surface therebelow, said first support member including:

a. a first leg means extending downwardly from said upper bar member to facilitate support thereof in spaced relation from the environmental surface to facilitate defining of a practicing zone therebeneath;

b. a second leg means extending downwardly from said upper bar member to facilitate support thereof in spaced relation from the environmental surface to facilitate defining of said practicing zone therebeneath, said second leg means extending outwardly away from said second leg means to define a guide orifice means therebetween;

(3) a second support member detachably securable with respect to said upper bar member at a position spatially disposed from said first support member for further supporting thereof above the ground surface therebelow, said first support member and said second support member together defining a practicing zone means therebetween below said upper bar member to facilitate use of the ice hockey training apparatus;

B. a longitudinal member extending into said practicing zone means through said guide orifice means defined between said first support member and said second support member below said upper bar member, said longitudinal member being flexibly resilient longitudinally, said longitudinal member including a knot means tied therewithin to restriction detachment of said longitudinal member from said blade means by removal of said longitudinal member from said aperture means;

C. a training stick means comprising:

(1) a handle means capable for being grasped by a user during training; and (2) a blade means fixedly secured to said handle means and adapted to be moved within said practicing zone means beneath said upper bar member and between said first support member and said second support member to enhance development of strength, balance and accuracy in stick handling by the user, said blade means defining at least one aperture means defined therein, said blade means adapted to receive said longitudinal member extending through said aperture means defined therein for detachable securement therewith, said longitudinal member providing flexible resistance to movement of said blade means of said training stick means within said practicing zone means to increase strength, balance and accuracy in shooting and stick handling of a user, said blade means including:

a. a heel section adjacent said handle means, said heel section defining said aperture means including a heel aperture means, said heel aperture means including a narrowed heel opening area in the region thereof closest to said handle means to facilitate retaining of said longitudinal member within said heel aperture means during proper practice shooting wherein the tip section of said blade means is turning over downwardly during follow through after a practice shot, said heel aperture means further including a widened heel opening area in the region thereof most distant from said handle means to facilitate release of said longitudinal member from within said heel aperture means during improper practicing shooting wherein the tip section of said blade means is turning facing upwardly during follow through after a practice shot, said heel aperture means defined in said heel section of said blade means being teardrop-shaped with the widest area closest to said tip area and the narrowest area thereof closest to said handle means to facilitate release of said longitudinal member therefrom responsive to improper shot follow through and to facilitate retaining of said longitudinal member therewithin responsive to proper shot follow through;

b. a tip section spatially disposed distant from said handle means and said heel area, said tip section defining said aperture means including a tip aperture means, said tip aperture means including a narrowed tip opening area in the region thereof closest to said handle means to facilitate retaining of said longitudinal member within said tip aperture means during proper practice shooting wherein the tip section of said blade means is turning over downwardly during follow through after a practice shot, said tip aperture means further including a widened tip opening area in the region thereof most distant from said handle means to facilitate release of said longitudinal member from within said tip aperture means during improper practicing shooting wherein the tip section of said blade means is turning facing upwardly during follow through after a practice shot, said tip aperture means comprising a tip open notch means defined in the tip area of said blade means most distant from said handle means, said tip aperture means defined in said tip section of said blade means being teardrop-shaped with the widest area closest to said tip area and the narrowest area thereof closest to said handle means to facilitate release of said longitudinal member therefrom responsive to improper shot follow through and to facilitate retaining of said longitudinal member therewithin responsive to proper shot follow through;

c. a central section located intermediate between said heel area and said tip area, said central section defining said aperture means including a central aperture means, said central aperture means including a narrowed central opening area in the region thereof closest to said handle means to facilitate retaining of said longitudinal member within said central aperture means during proper practice shooting wherein the tip section of said blade means is turning over downwardly during follow through after a practice shot, said central aperture means further including a widened central opening area in the region thereof most distant from said handle means to facilitate release of said longitudinal member from within said central aperture means during improper practicing shooting wherein the tip section of said blade means is turning facing upwardly during follow through after a practice shot, said central aperture means defined in said central section of said blade means being teardrop-shaped with the widest area closest to said tip area and the narrowest area thereof closest to said handle means to facilitate release of said longitudinal member therefrom responsive to improper shot follow through and to facilitate retaining of said longitudinal member therewithin responsive to proper shot follow through;

D. a target means secured to said second support member immediately adjacent said practicing zone means to provide a target for shooting and stick handling practice therewithin, said target means being made of hard rubber and shaped to simulate a hockey puck to enhance use thereof as a target during shooting and stick handling practice within said practicing zone means;

E. a weighted means positioned adjacent said first support member for attachment to said longitudinal member for fixed securement thereof outside of said practicing zone means, said weighted means defining a closable chamber opening means and a ballast chamber means therewithin in fluid flow communication with respect to one another, said closable chamber opening means being operable to facilitate removable placement of ballast into said weighing chamber means to increase the weight of said weighing means, said ballast chamber also being capable of being emptied of ballast through said closable chamber opening means for enhancing portability thereof;

F. a first rotatable platform means adapted to be placed adjacent said main framework means, said first rotatable platform means adapted to be stood upon by a user and being rotatable during use of the training apparatus for shooting and stick handling to facilitate simulation of on ice conditions and for reducing fatigue during practicing, said first rotatable platform means including:

(1) a first lower plate means engaging the ground adjacent said main framework means;

(2) a first upper plate means rotatably mounted with respect to said first lower plate means and adapted to be stood upon by a user during practicing;

(3) a first bearing means mounting between said first lower plate means and said first upper plate means to facilitate relative rotational movement therebetween; and G. a second rotatable platform means adapted to be placed adjacent said main framework means, said second rotatable platform means adapted to be stood upon by a user and being rotatable during use of the training apparatus for shooting and stick handling to facilitate simulation of on ice conditions and for reducing fatigue during practicing, said second rotatable platform means including:

(1) a second lower plate means engaging the ground adjacent said main framework means;

(2) a second upper plate means rotatably mounted with respect to said second lower plate means and adapted to be stood upon by a user during practicing;

(3) a second bearing means mounting between said second lower plate means and said second upper plate means to facilitate relative rotational movement therebetween.

* * * * *